US005573119A

United States Patent [19]

Luray

[11] Patent Number: 5,573,119

[45] Date of Patent: Nov. 12, 1996

[54] SHOCK ABSORBING SHIPPING PACKAGE

[76] Inventor: Howard L. Luray, 15730 Beach Dr. NE., Seattle, Wash. 98155

[21] Appl. No.: 249,673

[22] Filed: May 26, 1994

Related U.S. Application Data

[63] Continuation-in-part of Ser. No. 92,595, Jul. 15, 1993, abandoned.

[51] Int. Cl.[6] ..... B65D 81/07

[52] U.S. Cl. ..... 206/583; 206/523; 229/117.01

[58] Field of Search ..... 206/521–524, 206/583, 586, 587, 591–594; 229/117.01

[56] References Cited

U.S. PATENT DOCUMENTS

| | | | |
|---|---|---|---|
| 1,119,208 | 12/1914 | Weiss | 229/125.19 |
| 1,457,496 | 6/1923 | Butler . | |
| 1,578,673 | 3/1926 | Masury et al. . | |
| 1,611,906 | 12/1926 | Gurney . | |
| 1,939,538 | 12/1933 | Buhr | 248/31 |
| 2,308,969 | 1/1943 | Riesing | 248/54 |
| 2,553,418 | 5/1951 | Loth | 229/14 |
| 2,729,327 | 1/1956 | Roy | 206/46 |
| 2,771,184 | 11/1956 | Ryno et al. | 206/46 |
| 2,932,546 | 4/1960 | Marggraf et al. | 312/352 |
| 2,933,183 | 4/1960 | Koelsch | 206/46 |
| 2,979,246 | 4/1961 | Liebeskind | 206/523 |
| 3,003,622 | 10/1961 | Hardigg | 206/523 |
| 3,003,656 | 10/1961 | Hardigg | 206/523 |
| 3,063,613 | 11/1962 | McClive | 206/586 |
| 3,161,339 | 12/1964 | Weller | 206/523 |
| 3,314,584 | 4/1967 | Knapp et al. | 206/523 |
| 3,346,221 | 10/1967 | Farmer | 248/24 |
| 3,521,743 | 7/1970 | Sposito, Jr. | 206/46 |
| 3,606,135 | 9/1971 | Rosenburg, Jr. | 229/132 |
| 3,635,332 | 1/1972 | Ross | 206/46 |
| 3,692,264 | 9/1972 | Burkhard et al. | 248/15 |
| 3,829,005 | 8/1974 | Hackenberg et al. | 229/132 |
| 3,853,220 | 12/1974 | Luray | 206/466 |
| 4,013,170 | 3/1977 | Hutterer | 206/521 |
| 4,296,907 | 10/1981 | Ishida et al. | 248/573 |
| 4,355,791 | 10/1982 | Dean | 267/136 |
| 4,569,082 | 2/1986 | Ainsworth et al. | 383/3 |
| 4,606,459 | 8/1986 | Luray | 206/583 |
| 4,606,460 | 8/1986 | Luray | 206/583 |
| 5,226,542 | 7/1993 | Boecker et al. | 206/583 |
| 5,232,095 | 8/1993 | Childers et al. | 206/583 |

FOREIGN PATENT DOCUMENTS

| | | | |
|---|---|---|---|
| 1580910 | 9/1969 | France . | |
| 2601655 | 1/1988 | France | 206/586 |
| 475299 | 11/1937 | United Kingdom . | |
| 2106249 | 4/1983 | United Kingdom . | |

*Primary Examiner*—Jimmy G. Foster

*Attorney, Agent, or Firm*—Christensen O'Connor Johnson & Kindness

[57] ABSTRACT

An outer support in the form of a rigid outer container has resilient cushioning material, such as resilient foam, at each end. A smaller inner container is supported solely on the cushioning material and carries a fragile article to be shipped. Shock absorbing motion of the inner container is allowed by reciprocal deformation of the cushioning material at the opposite ends.

27 Claims, 14 Drawing Sheets

Fig. 5.
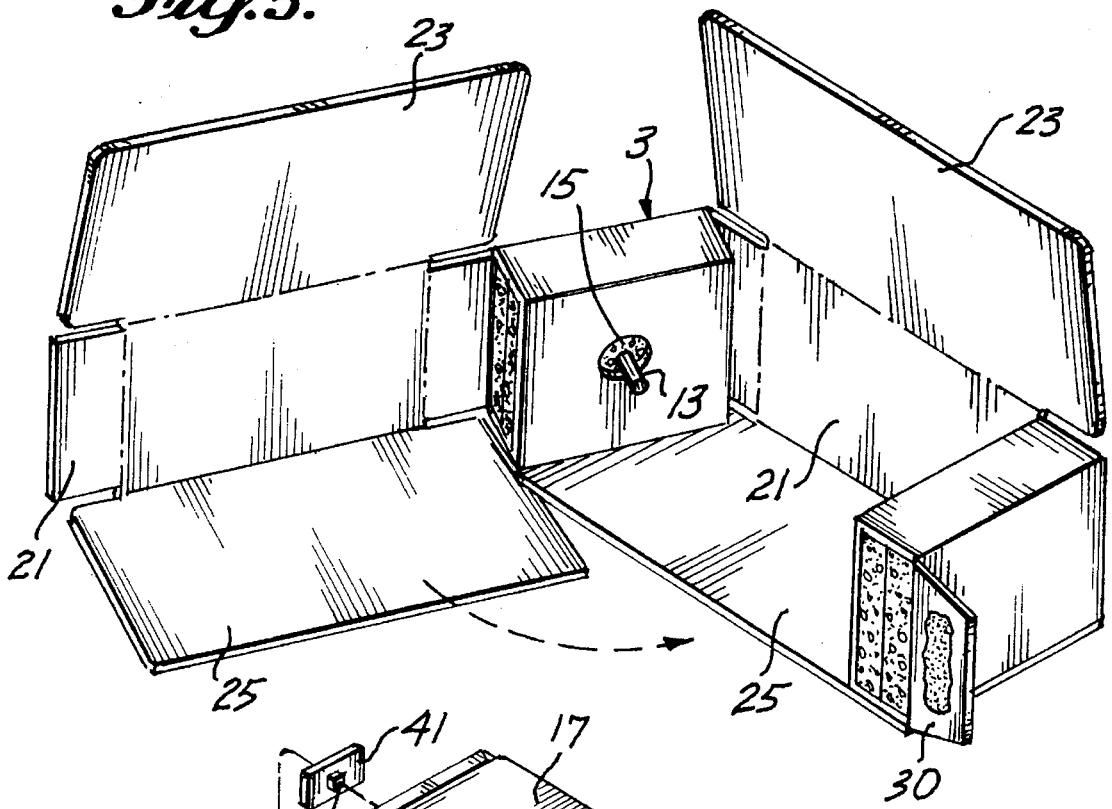
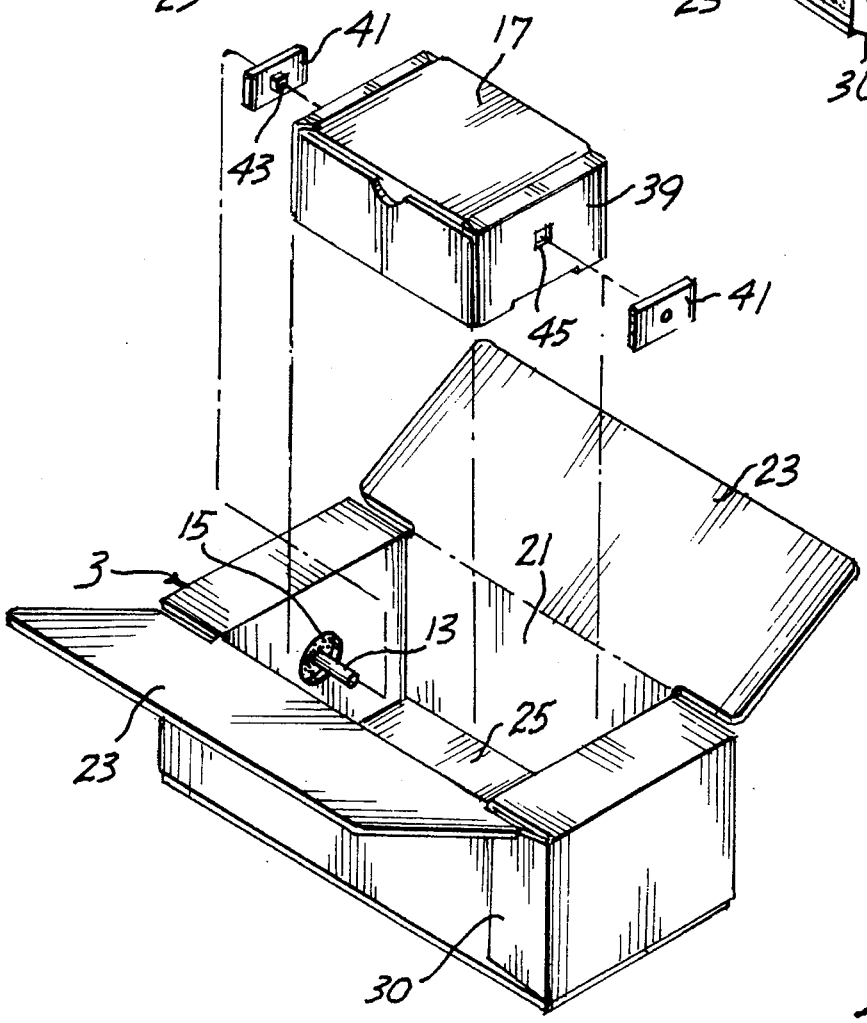
Fig. 6.

Fig. 7.
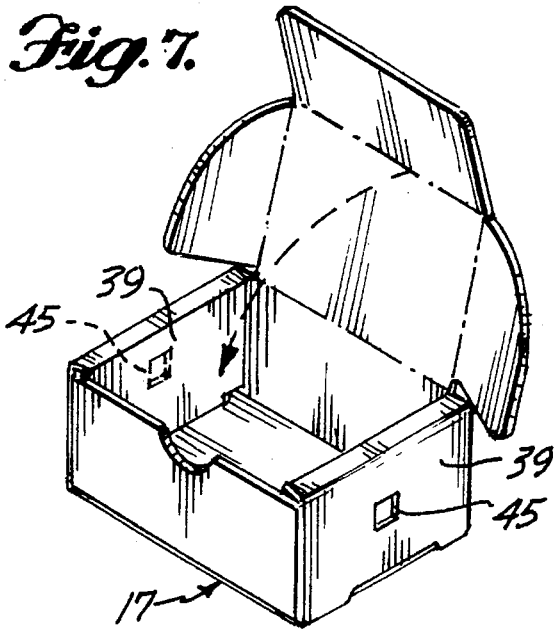
Fig. 8.
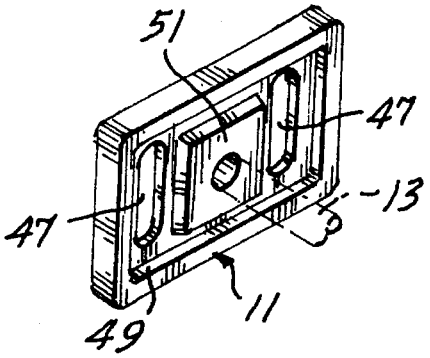
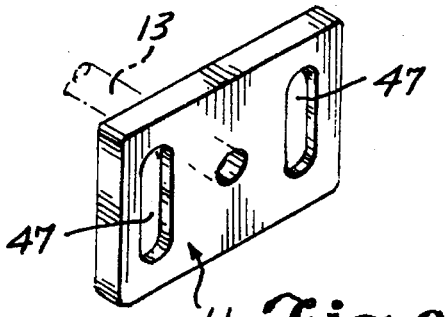
Fig. 9.
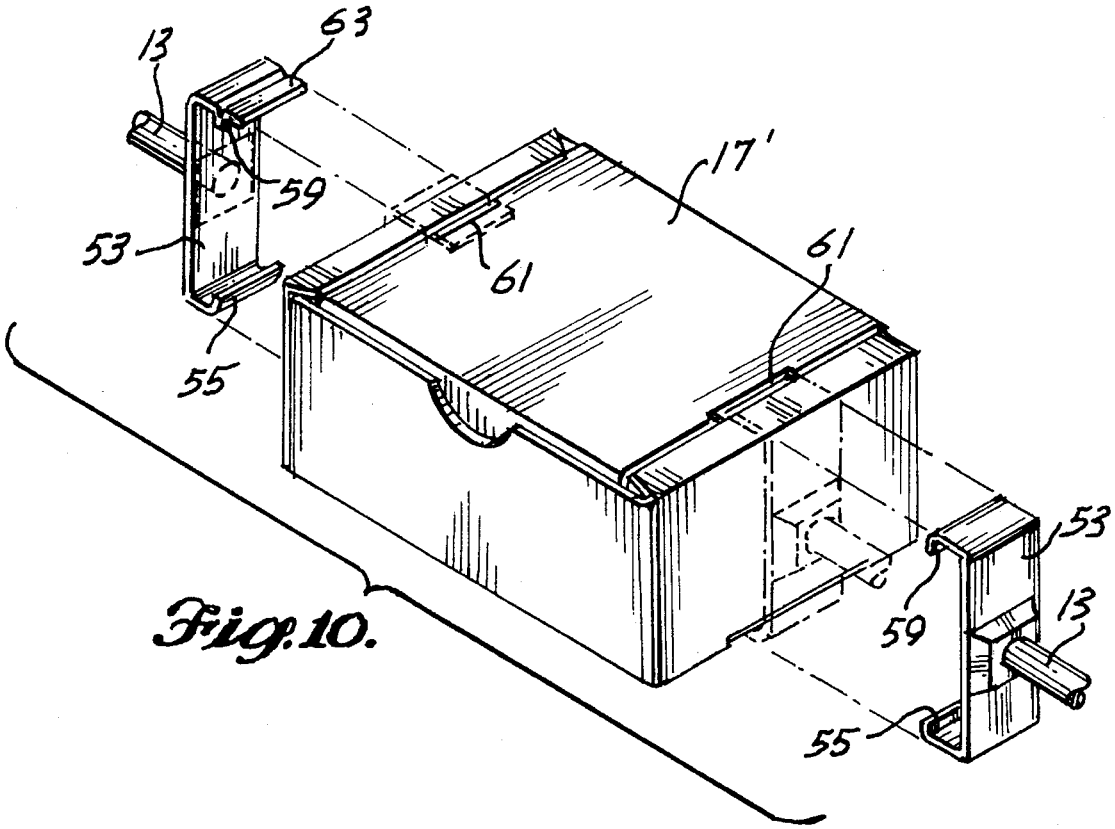
Fig. 10.

SHOCK ABSORBING SHIPPING PACKAGE

CROSS REFERENCE

This application is a continuation-in-part of my application Ser. No. 08/092,595, now abandoned, titled "Shock Absorbing Shipping Package," which was filed on Jul. 15, 1993, and which is expressly incorporated by reference herein.

FIELD OF THE INVENTION

The present invention relates to a special article holder. More specifically, the present invention relates to a shipping container for a fragile article to cushion the article against jolts which may damage the article.

BACKGROUND OF THE INVENTION

Various types of packaging have been proposed in the past to protect fragile articles during shipment, including the packaging shown in my prior U.S. Pat. Nos. 3,853,220; 4,606,459; and 4,606,460; and the patents referred to therein and/or cited as references against the applications resulting in those patents. Often, the packaging components are of complicated construction, bulky, difficult to use or limited with respect to the size, weight or types of fragile articles that can be shipped.

SUMMARY OF THE INVENTION

The present invention provides a packaging system using inexpensive components which are reusable, and which is adaptable to a wide variety of articles to be shipped and can be knocked down to compact form when not in use. In one embodiment, an outer support in the form of a rigid outer container is formed with narrow chambers at each end. The chambers are filled with resilient cushioning material in which rigid plates are embedded. The plates are smaller than the chambers so that they are resiliently movable against the centering force applied by the cushioning material. Support arms extend inward from the plates through openings in the chambers toward the interior of the outer container. An inner carrier in which the article is packaged is firmly supported on the arms. The outer container is sized such that the inner carrier is spaced from the walls of the outer container on all sides. Shock absorbing motion of the support arms is allowed by reciprocal movement of the plates within the chambers, the enclosed cushioning material always returning the plates and arms to a central position.

In the preferred embodiment, an outer support member or container can be formed from a one-piece blank of substantially rigid material, such as corrugated cardboard. The blank is foldable to form a hollow box having internal opposite end faces. A cushion member, such as a pad of resilient foam, is secured to each interior end face of the box. A smaller article carrier or container is sized to fit within the outer box, with the opposite ends of the carrier adhered to the exposed inner surfaces of the cushion members. While the ends of the inner article carrier are affixed to the cushion members at the ends of the outer box, the top, bottom and sides of the inner article carrier are spaced inward from the corresponding parts of the box. The inner article carrier is held in a central equilibrium position from which it is free to move in all directions without contacting the box, resiliently restrained by the reciprocal action of the cushion members interposed between the ends of the carrier and the ends of the box.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 5 is a top perspective corresponding to FIGS. 2, 3, and 4, but with parts in different positions illustrating subsequent steps in the procedure of forming the outer support member used in the first embodiment of shock absorbing shipping package in accordance with the present invention;

FIG. 6 is a somewhat diagrammatic top perspective of the substantially fully formed outer support member and an inner article carrier ready for insertion into the support member;

FIG. 7 is a top perspective of a representative inner carrier member of a type usable in the first embodiment of shock absorbing shipping package in accordance with the present invention;

FIG. 8 is an enlarged top front perspective of an interior component of the first embodiment of shock absorbing shipping package in accordance with the present invention, and FIG. 9 is an enlarged top rear perspective of such component;

FIG. 10 is a fragmentary top perspective of a modification for the first embodiment of shock absorbing shipping package in accordance with the present invention, namely, an alternative form of interface between the outer support member and the inner carrier member;

Figure 13:
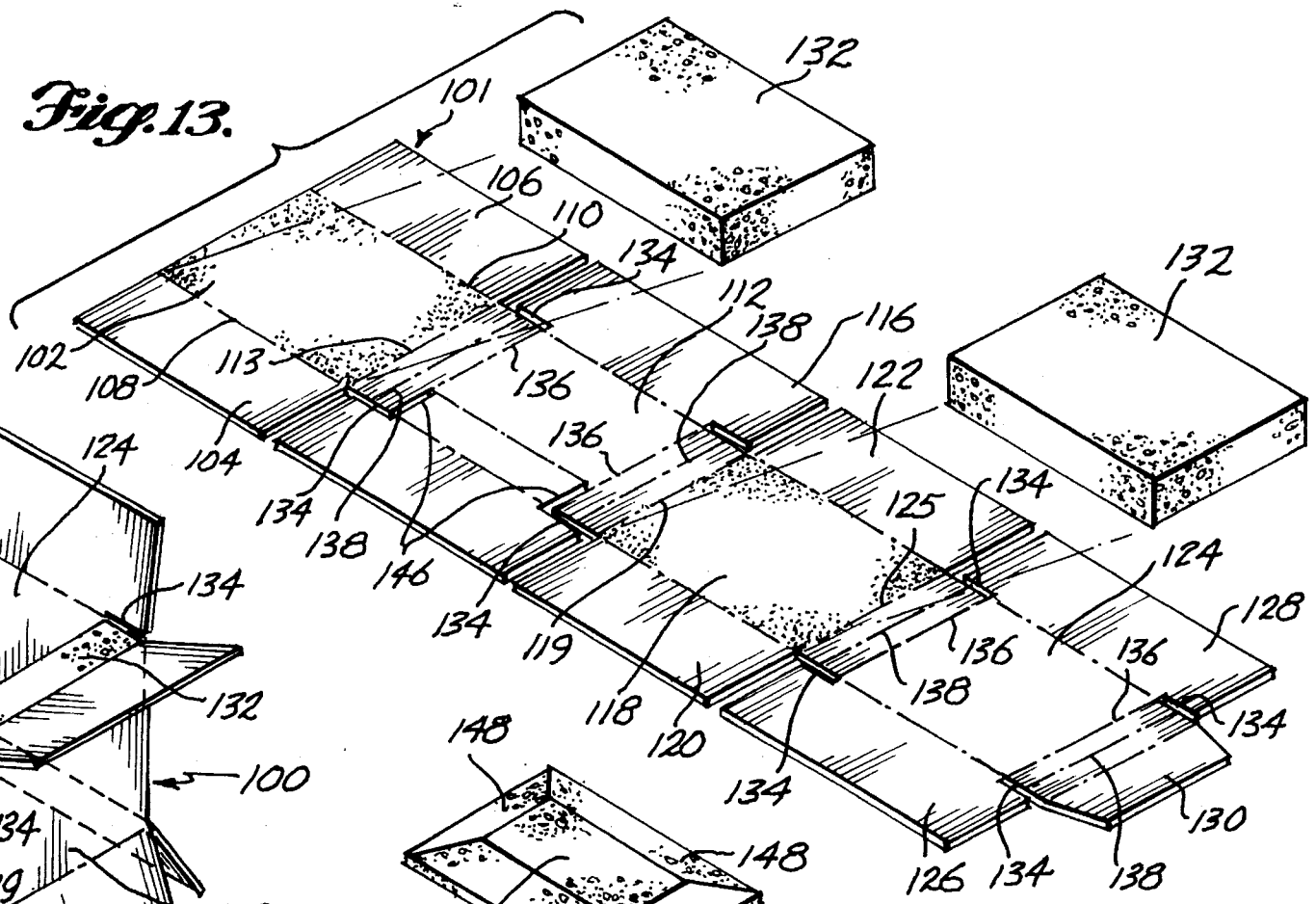
FIG. 13 is a somewhat diagrammatic top perspective of an unfolded one-piece box blank and cushion members for forming an outer support member of a second embodiment of shock absorbing shipping package in accordance with the present invention.
Figure 27:
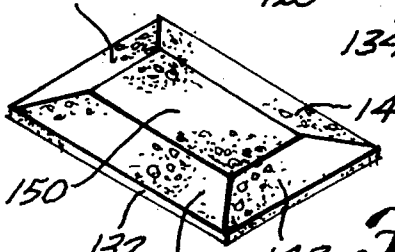
Figure 19:
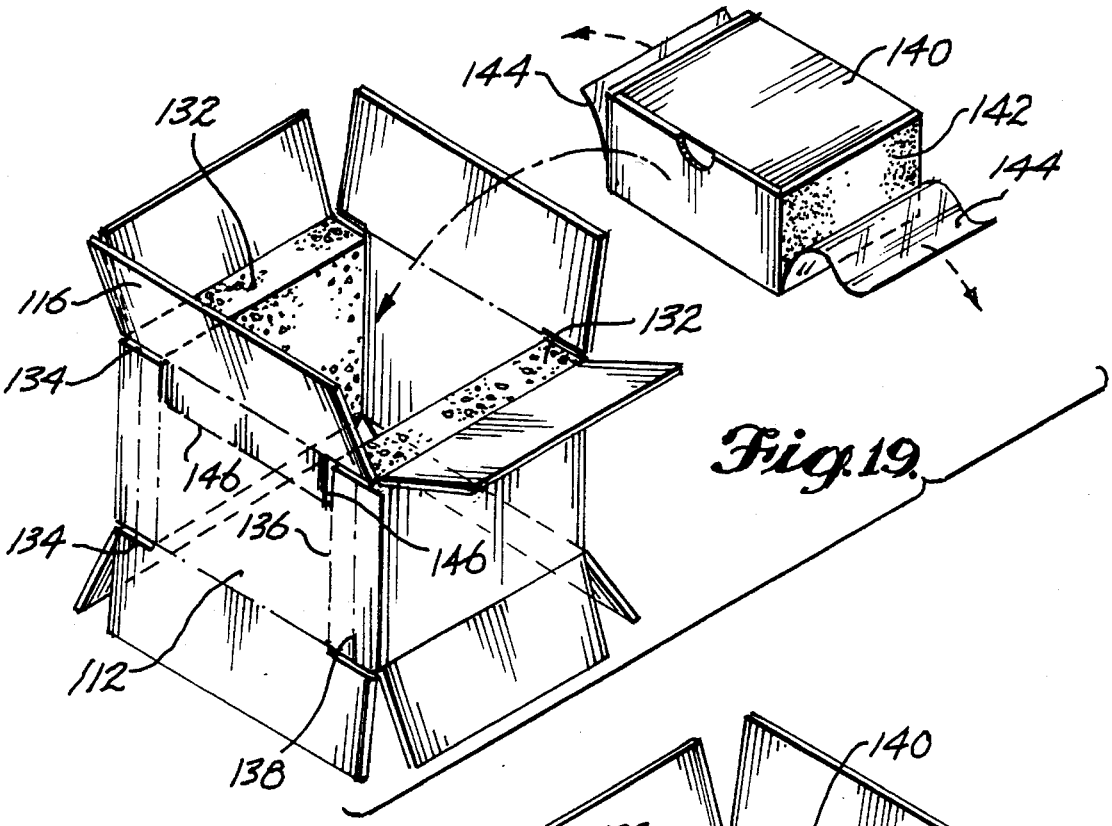
Figure 20:
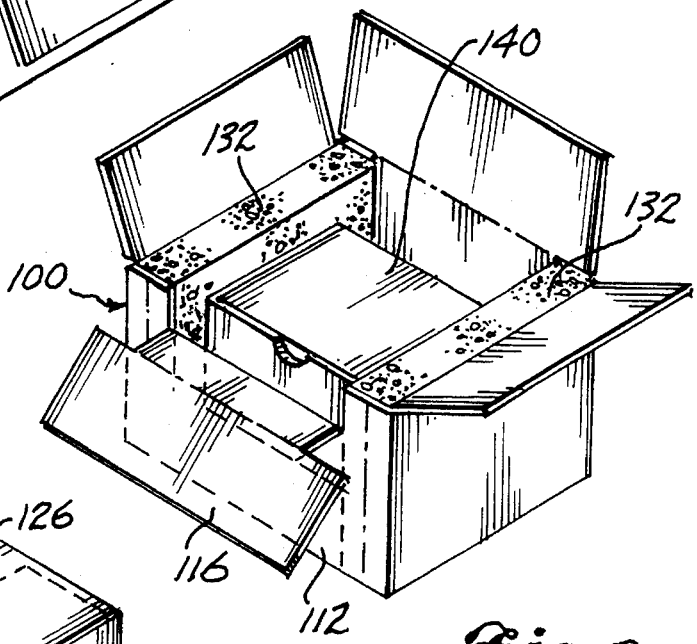
Figure 21:
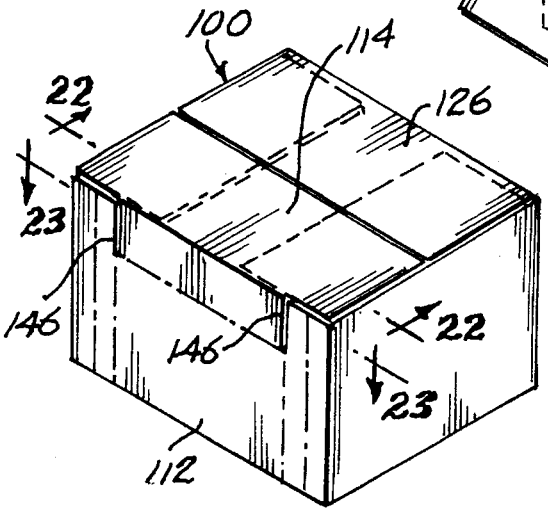
Figure 22:
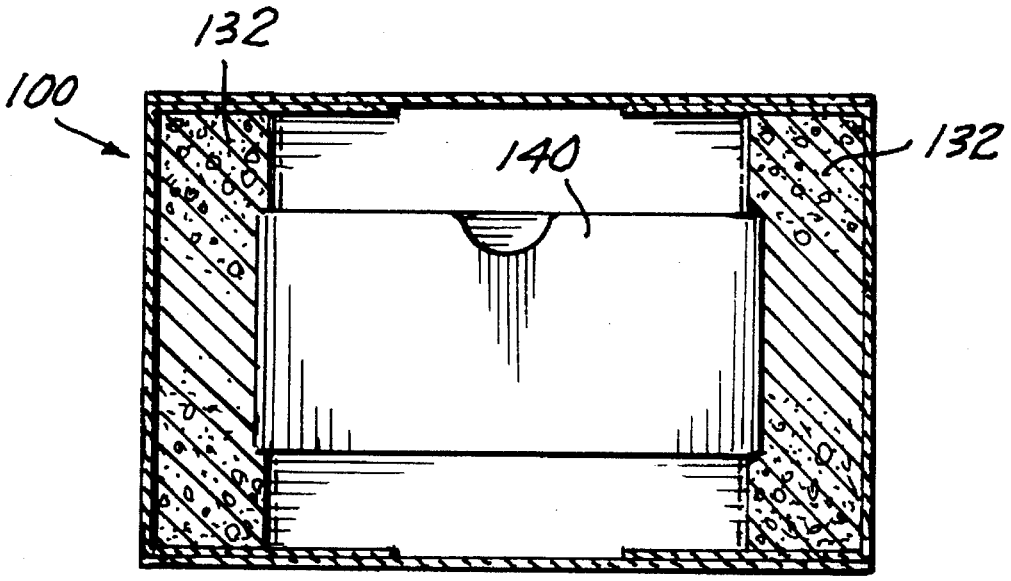
Figure 23:
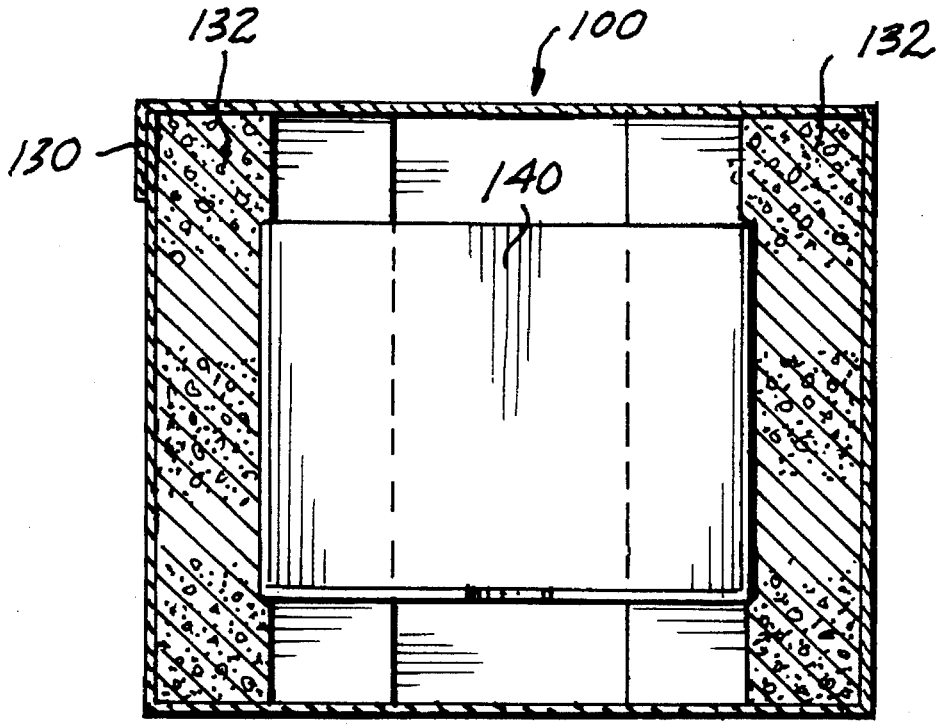
Figure 24:
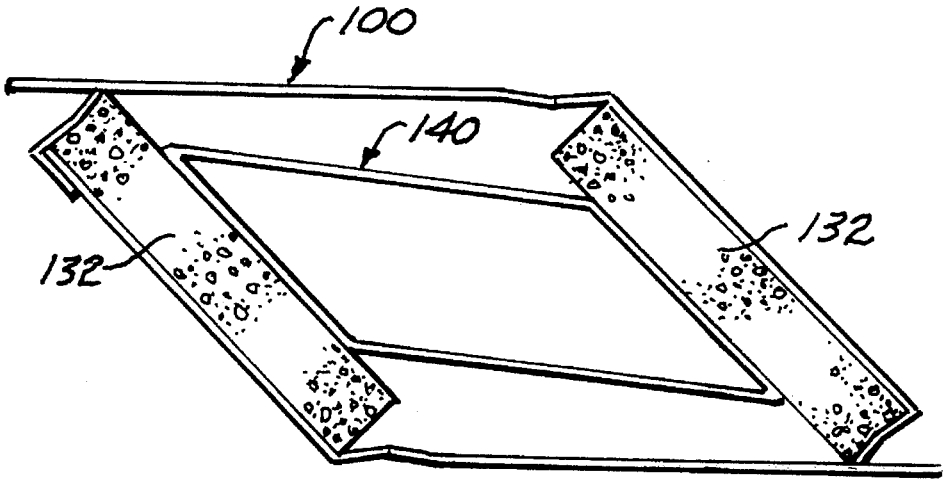
Figure 25:
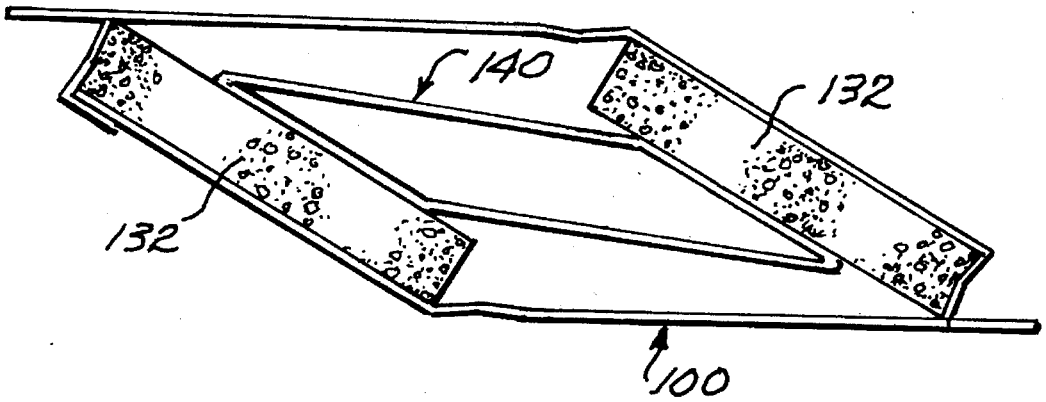
Figure 26:
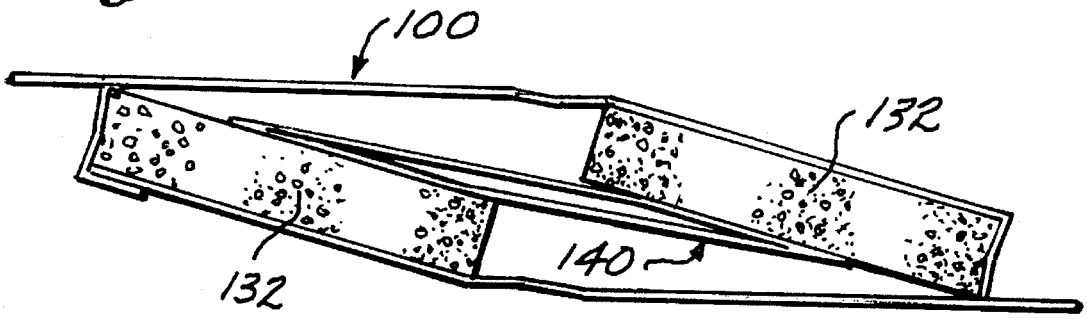
Figure 28:
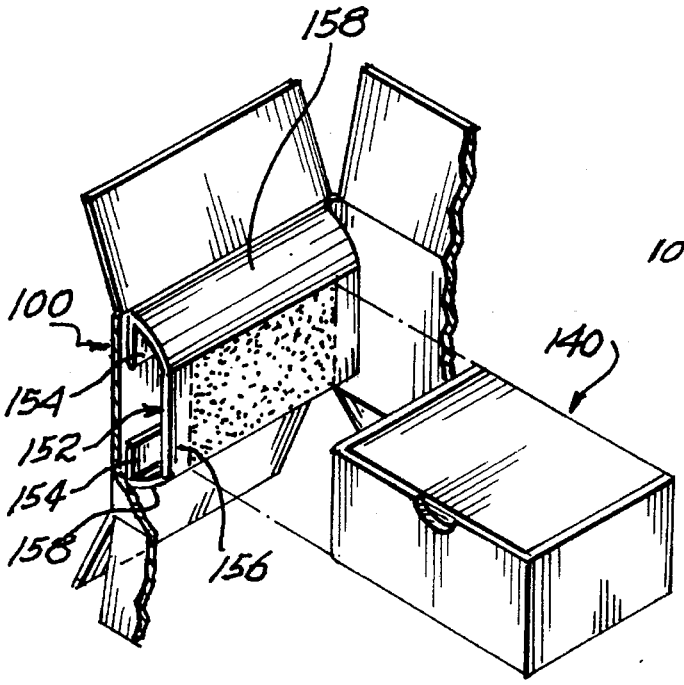
Figure 29:
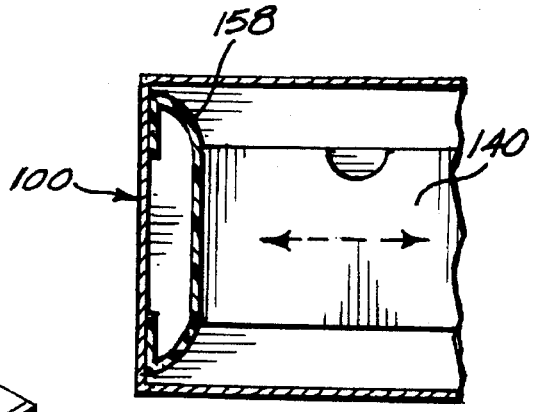
Figure 30:
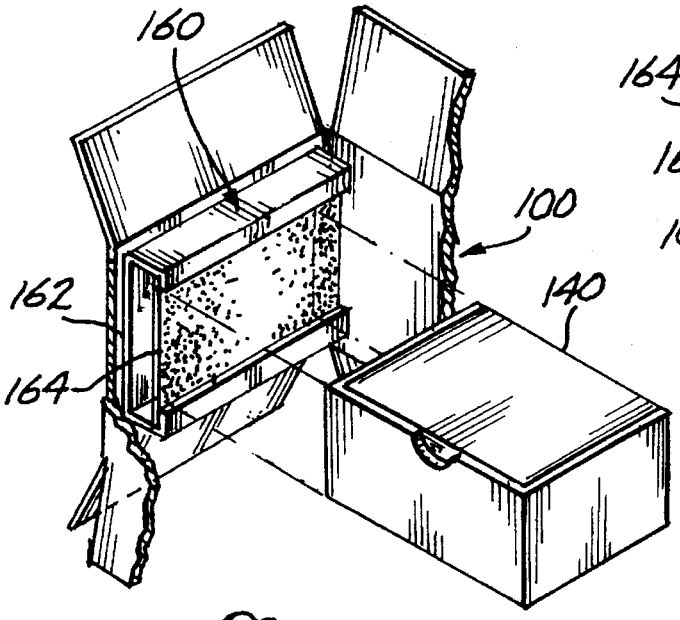
Figure 31:
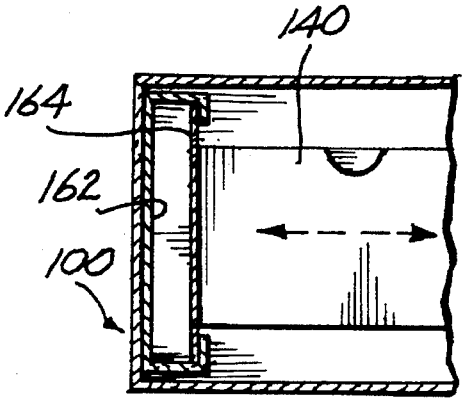
Figure 32:
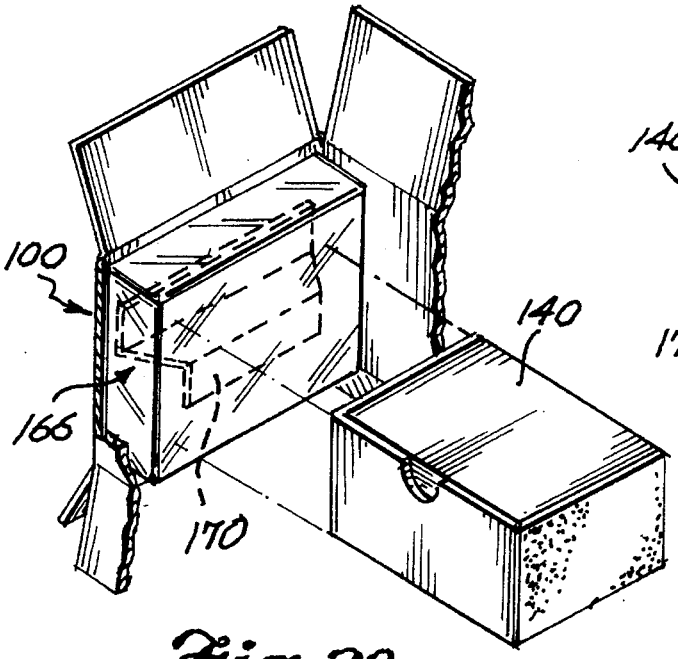
Figure 33:
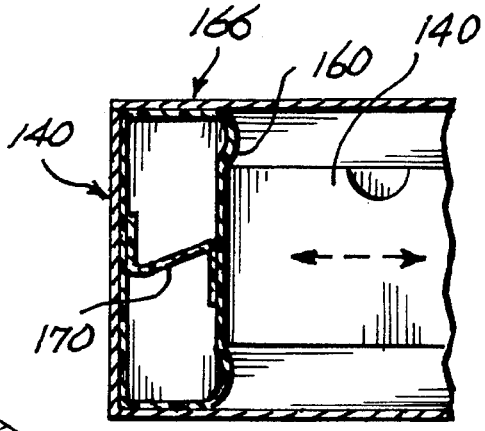
Figure 34:
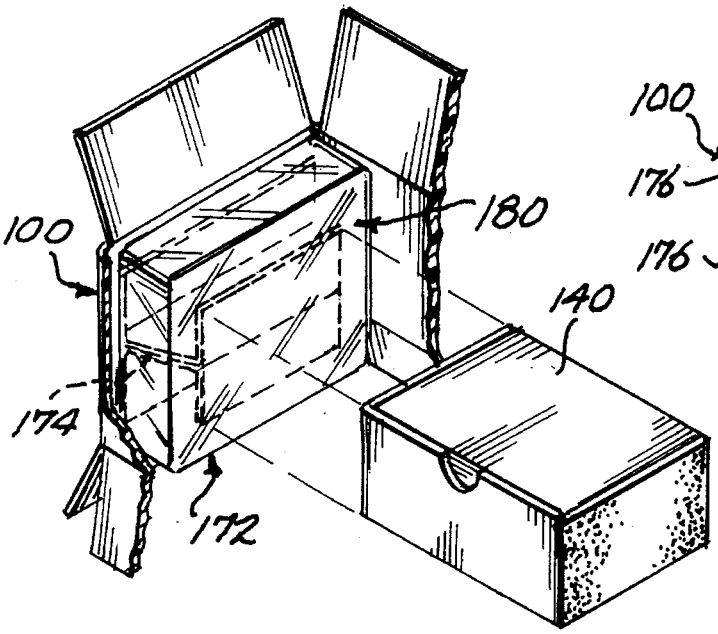
Figure 35:
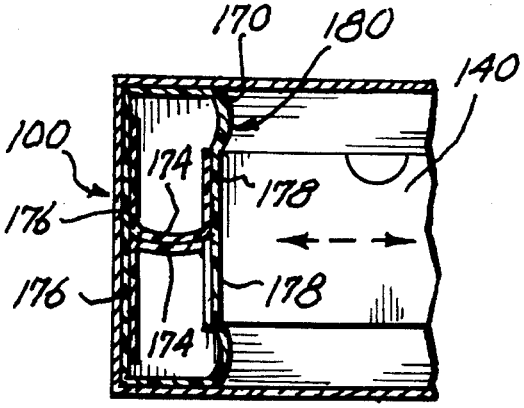
Figure 36:
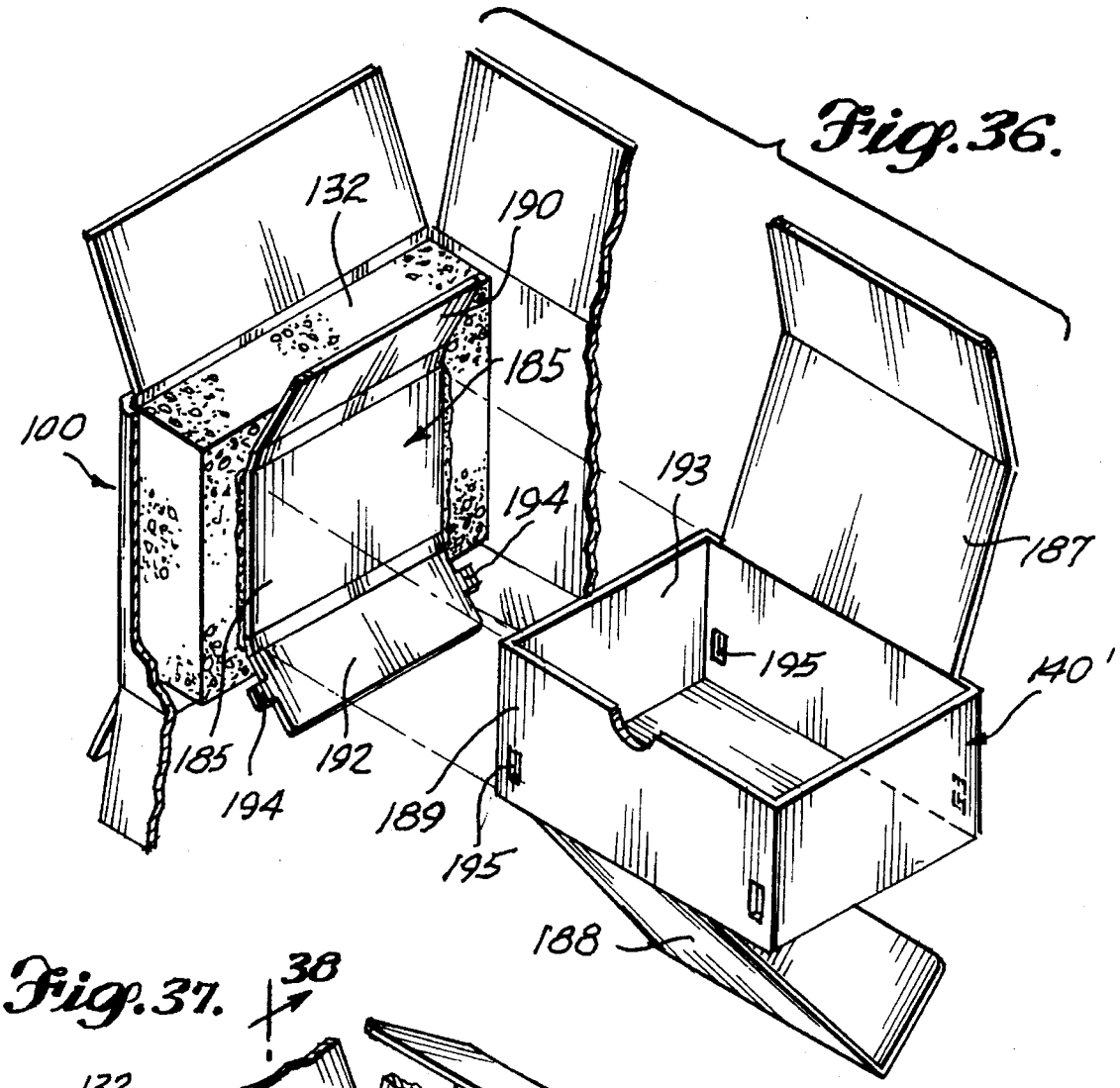
Figure 37:
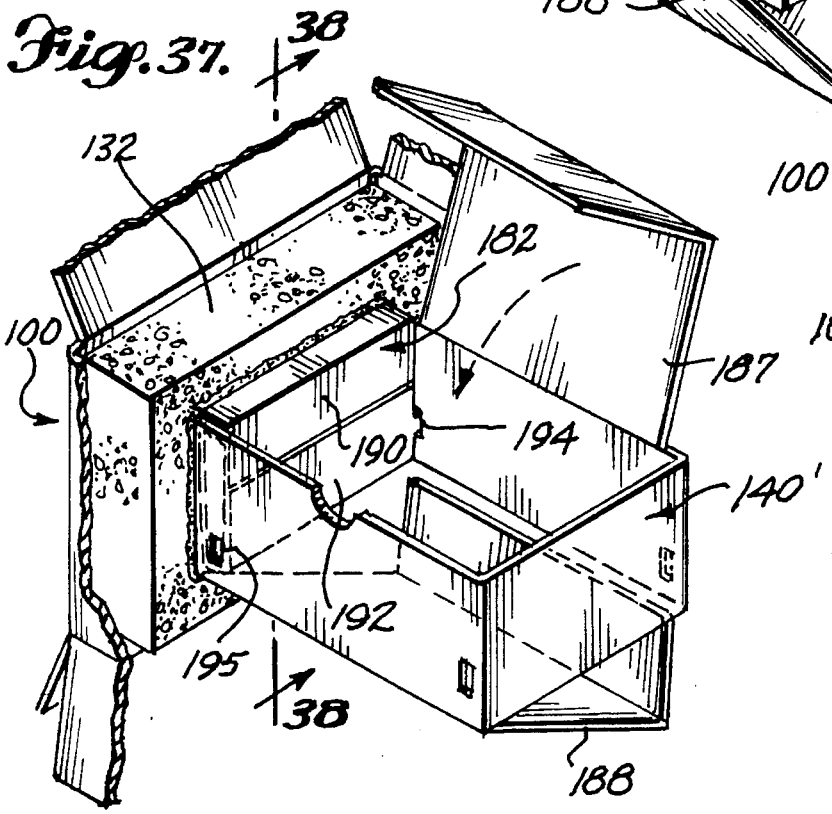
Figure 38:
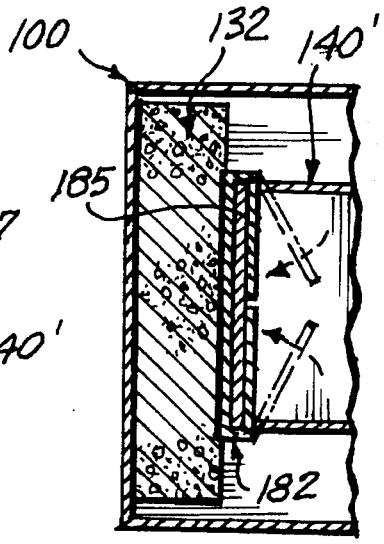
Figure 39:
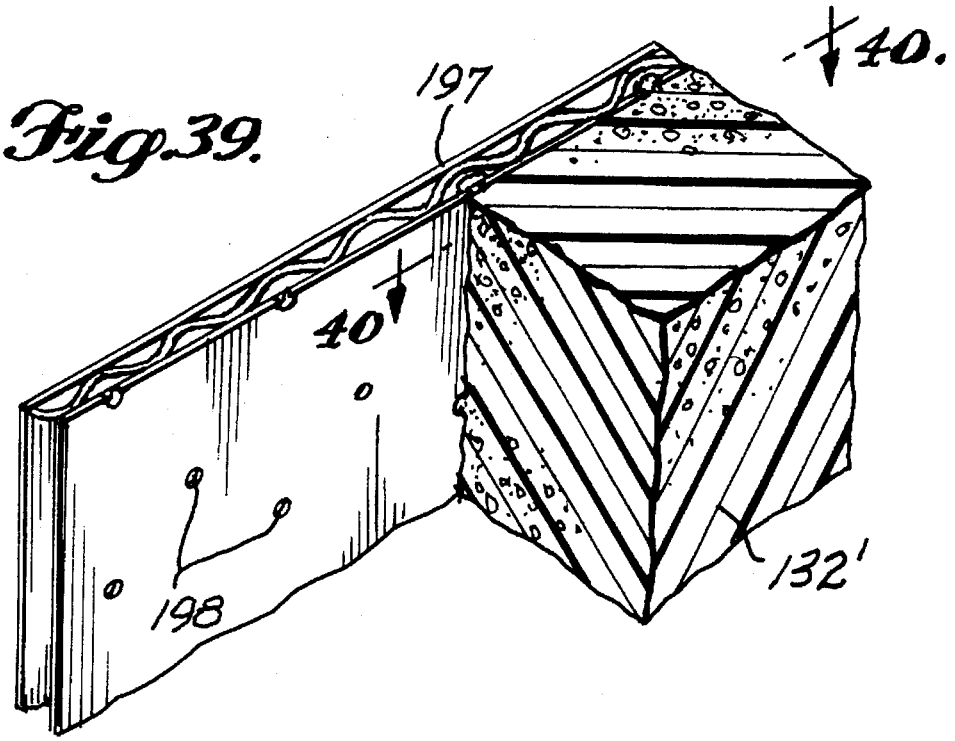
Figure 40:
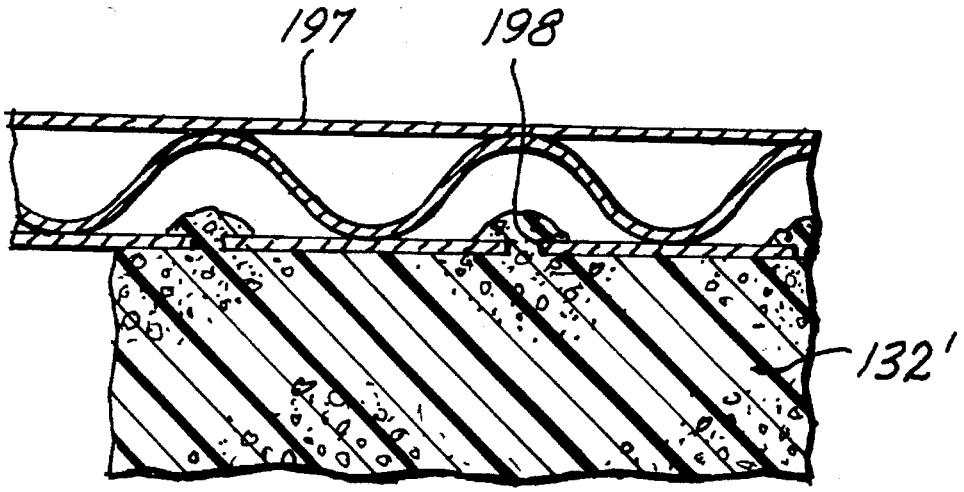

FIG. 19 is a somewhat diagrammatic top perspective of the second embodiment of shock absorbing shipping package in accordance with the present invention illustrating insertion of an inner article carrier into an outer support member;

FIG. 20 and FIG. 21 are corresponding top perspectives of the second embodiment of shock absorbing shipping package in accordance with the present invention, but with parts in different positions;

FIG. 22 is a section along line 22—22 of FIG. 21;

FIG. 23 is a section along line 23—23 of FIG. 21;

FIG. 24, FIG. 25, and FIG. 26 are corresponding top plans of the second embodiment of shock absorbing shipping package in accordance with the present invention, with parts shown in different positions to illustrate folding of the shipping package from an open position to a closed, more compact condition;

FIG. 27 (on the drawing sheet with FIG. 13 and FIG. 14) is top perspective of a modified component of the second embodiment of shock absorbing shipping package in accordance with the present invention, namely, a modified end cushion member;

FIG. 28 is a somewhat diagrammatic, fragmentary, top perspective illustrating another modified cushion member for such second embodiment, and FIG. 29 is a fragmentary vertical longitudinal section illustrating such modified cushion member;

FIG. 30 is a somewhat diagrammatic, fragmentary, top perspective illustrating another modified cushion member for such second embodiment, and FIG. 31 is a fragmentary vertical longitudinal section illustrating the modified cushion member of FIG. 30;

FIG. 32 is a fragmentary top perspective corresponding to FIGS. 28 and 30 illustrating another modified cushion member, namely, a pneumatic air bag, and FIG. 33 is a vertical longitudinal section illustrating the modified cushion member of FIG. 32;

FIG. 34 is a fragmentary top perspective corresponding to FIGS. 28, 30 and 32 illustrating still another modified form of cushion member, namely, a modified pneumatic air bag, and FIG. 35 is a fragmentary vertical longitudinal section of such modified air bag;

FIG. 36 is a top perspective of an end portion of another modification of the second embodiment of the present invention having components for mechanically securing an inner article carrier within an outer support member, with parts broken away;

FIG. 37 is a fragmentary top perspective corresponding to FIG. 36 but with parts in different positions;

FIG. 38 is a fragmentary vertical section along line 38—38 of FIG. 37;

FIG. 39 is an enlarged fragmentary top perspective of an end portion of an outer support member of the general type used in the second embodiment of the present invention having a foamed-in-place cushion member; and FIG. 40 is a further enlarged fragmentary vertical section along line 40—40 of FIG. 39.

Detailed Description of the Preferred Embodiment

Figure 1:
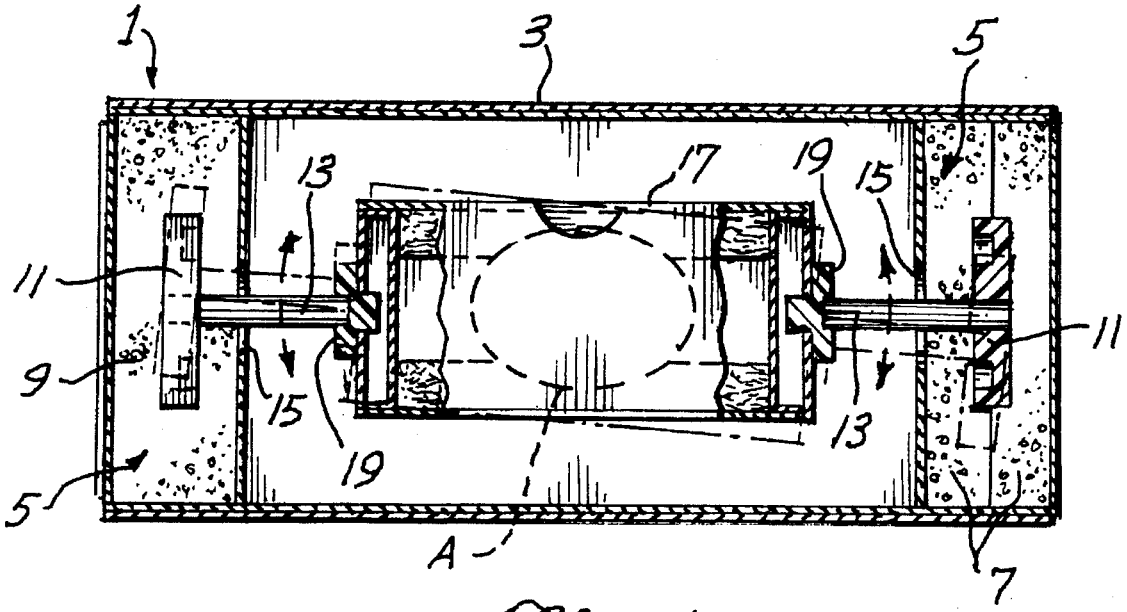
FIG. 1 is a side elevation of a first embodiment of a shock absorbing shipping package in accordance with the present invention including an outer support member and an inner article carrier, with most pans shown in section.

In the first embodiment shown in FIG. 1, the shock absorbing shipping package 1 in accordance with the present invention includes an outer support member 3 which preferably is in the form of an outer container or box. The outer support member or box 3 has substantially closed chambers 5 at opposite ends or sides. Chambers 5 are filled with resilient cushioning material, such as side-by-side sheets 7 shown in the right chamber or a single pad 9 as shown in the left chamber. Other alternatives are particulate material or one or more air bags, but resilient foam sheets or preformed or foamed in place pads are preferred because they will retain their shape and are not susceptible to damage by puncture.

Rigid plates 11 are embedded in the cushioning material, approximately centered in the chambers 5. Substantial distance is provided between the ends and sides of each plate 11 and the adjacent walls of the corresponding chamber. A rigid support arm or neck 13 projects inward from each plate 11 through a hole 15 in the inner wall of the chamber toward an inner carrier 17 for the article A to be shipped. Arms 13 carry connection components 19 at their inner ends to be joined to the inner carrier 17.

Preferably the outer support member 3, including the walls of the chambers 5, and also the plates 11, arms 13, connection components 19 and the carrier 17 for the article A all are substantially rigid. Nevertheless, because of the embedding of the plates 11 in the cushioning material, arms 13 are movable relative to the outer support member for resiliently supporting the article carrier in the support member or container 3. The article is shielded by the walls of the carrier 17 and the outer support member or box 3, and is resiliently supported inside the article container for effective shock absorbing in the case of abrupt jolts or shocks applied to the package, such as if it is dropped, bumped, jostled, or kicked. Movement of the composite support for the inner container at one end is resiliently resisted by the cushioning material at that end, and also by reciprocal action at the opposite end. For example, endwise movement of the inner container is resiliently resisted by the cushioning material at both ends, just as transverse movement is cooperatively resisted by the cushioning materials at both ends.

Figure 2:
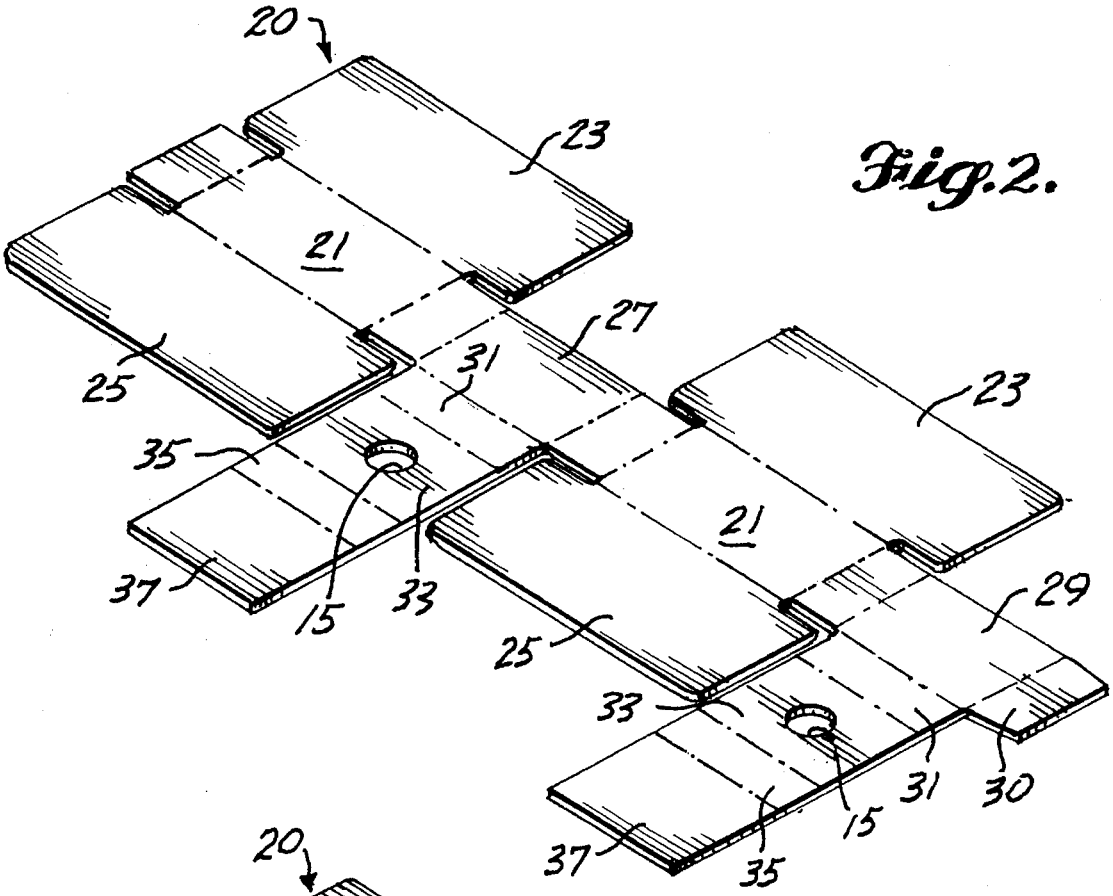
FIG. 2 is a top perspective of a one-piece box blank from which the outer support member of FIG. 1 can be formed.

The chambers 5 can be formed separately and secured within the remainder of the support member 3. However, as illustrated in FIGS. 2–6, preferably the support member and chambers are formed of a single one-piece box blank 20 of substantially rigid material such as heavy paperboard or corrugated cardboard. With reference to FIG. 2, the one-piece blank 20 includes two side panels 21 having integral top flaps 23 and bottom flaps 25. One end panel 27 extends between adjacent ends of the side panels 21, whereas the opposite end panel 29 is cantilevered from one of the side panels 21, but in alignment with end panel 27. A glue tab 30 extends from end panel 29 at the opposite side from the adjacent side panel 21. The chamber forming portions of the blank include bottom panels 31, interior wall panels 33 (which have the holes 15), top panels 35 and outer end panels 37. The broken lines in FIG. 2 represent scoring lines or perforations for ease in folding the blank.

Figure 3:
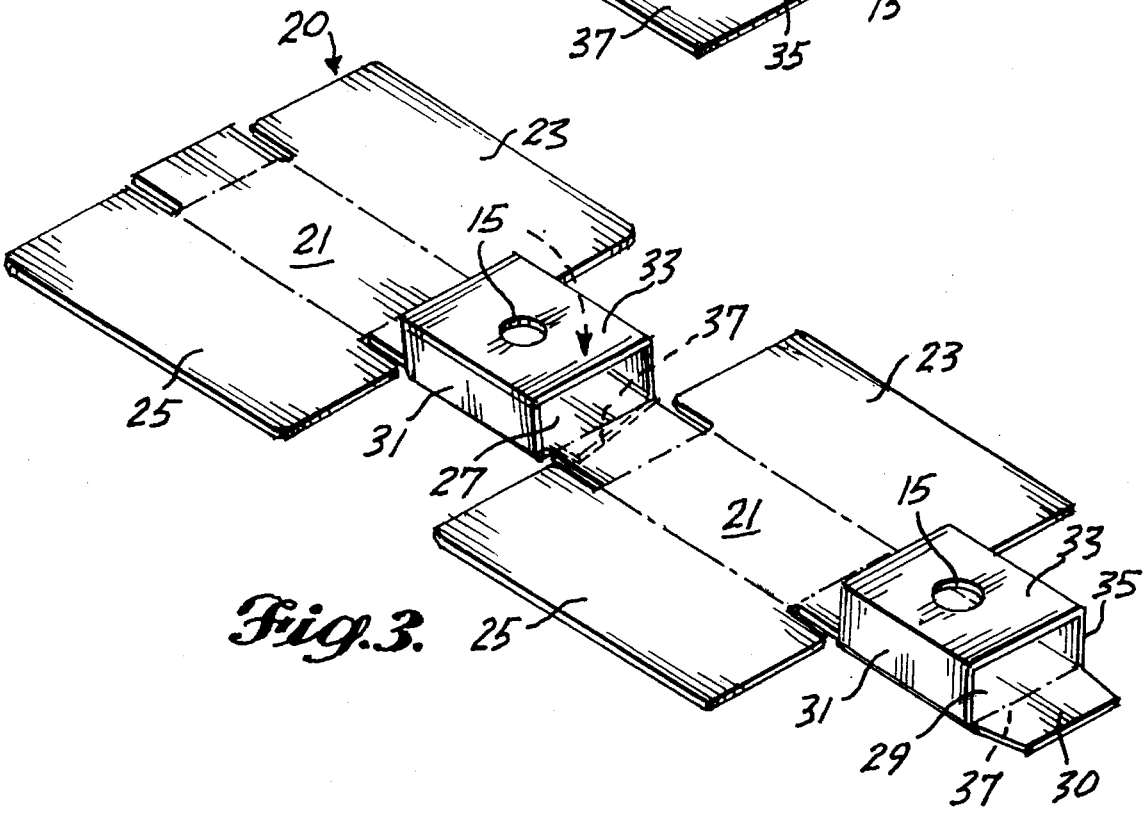
FIG. 3 is a top perspective corresponding to FIG. 2 but with pans in different positions to illustrate steps of the procedure of forming the outer support member from the blank of FIG. 2.

With reference to FIG. 3, the first step in forming the outer support member or container is to fold the chamber sections into rectangular configuration. For example, end panel 27 of the container is joined to the chamber bottom panel 31, inner wall panel 33, top panel 35 and outer end wall panel 37 by spaced parallel scoring lines such that the chamber can be folded to the rectangular condition illustrated in FIG. 3. The exterior wall panel 37 is glued or otherwise joined to the end panel 27 for double-layered rigidity at the end. The other end chamber is similarly folded to rectangular shape from end panel 29.

Figure 4:
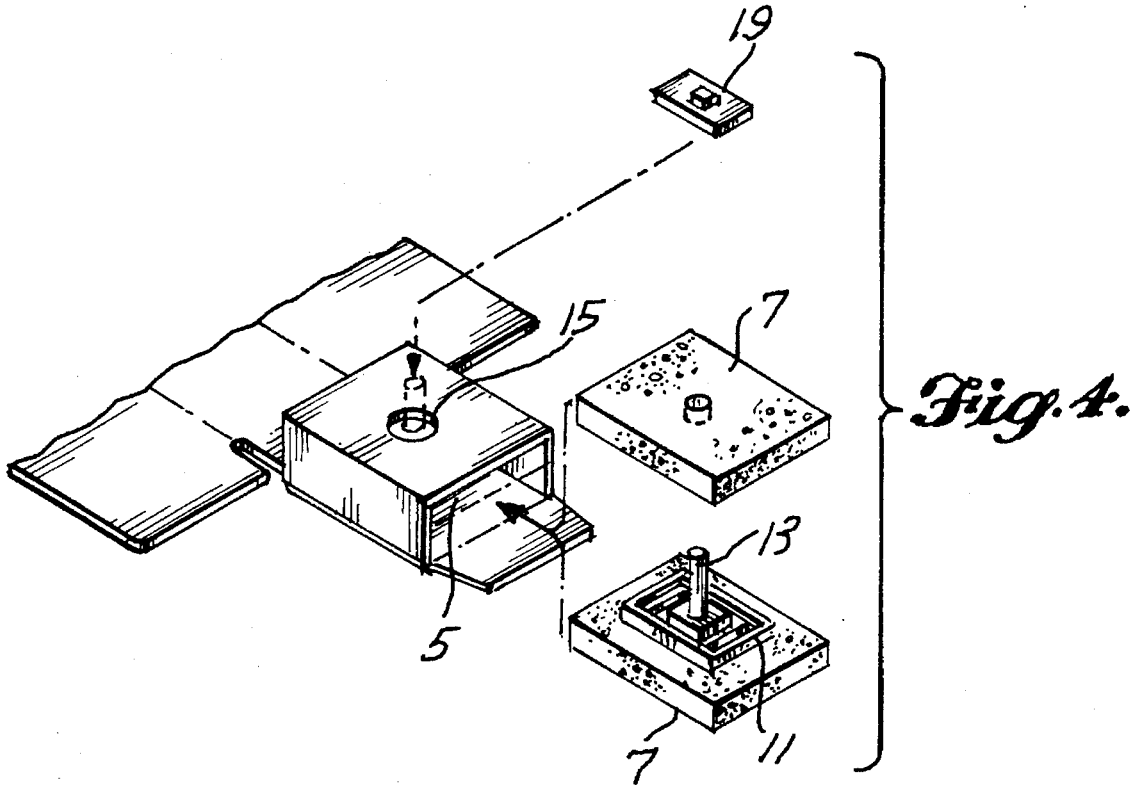
FIG. 4 (on the drawing sheet with FIG. 1) is a somewhat diagrammatic top perspective of an end portion of the partially folded support member of FIG. 3, but with cushioning components of the shock absorbing shipping package in accordance with the present invention partially assembled prior to insertion into the support member.

During assembly of the end chambers, the cushioning material can be inserted as illustrated diagrammatically in FIG. 4. For example, two resilient sheets 7 in which the plate 11 with its projecting arm 13 is embedded can be centered in each chamber 5, with the arms 13 projecting through the holes 15. Preferably the two resilient sheets 7 are joined together, such as by gluing, to position the plate stably in the center. An alternative is to inject liquid foam material into the chambers after they have been formed, preferably with thin plastic liners to restrict the foam's expansion.

With reference to FIG. 5 and FIG. 6, next the side panels 21 are swung inward along the open sides of the chambers. Then the glue tab 30 is folded alongside the adjacent end portion of the adjacent side panel 21 and secured in position along the outer portion of the container by adhesive or staples. The bottom flaps 25 are folded inward below the end chambers and can be secured in position by taping, mechanical fasteners or standard lock tabs. At this stage (FIG. 6) the top of the container 3 is left open for insertion of the article carrier 17.

With reference to FIG. 7, the inner article container can be a standard cardboard mailer having double thickness end walls 39. However, container 17 must be modified for interconnection with the inwardly extending arms 13 (FIG. 6). In the embodiment illustrated in FIGS. 6 and 7 arms 13 have connector plates or flanges 41 secured to their inner ends. Each connector has a rectangular projection 43 extending from its inner face and sized to fit snugly in a corresponding rectangular hole 45 in the end walls 39 of the article carrier 17. The cushioning material in the end chambers is sufficiently resilient to allow the arms 13 to be wedged apart for insertion of the article carrier 17. Finally, the top flaps 23 of the article carrier are closed, one overlying the other, and the flaps can be secured in the closed position by taping, mechanical fasteners or standard interfitting lock tabs.

The plates embedded in the chambers can be solid, but, as seen in FIGS. 8 and 9, preferably have large through apertures 47 for less resistance to translation or pivoting within the chambers. If the plates are solid, more of the cushioning material must be displaced in order for the plates to move within the chambers in a direction parallel to the length of the arms 13, and there will be much less resistance to lateral and up and down shifting of the plates than to endwise shifting or pivoting. A circumferential rib 49 and raised central portion or hub 51 can be provided for strength and rigidity.

Various manners of attaching the article carrier to the inward-extending arms can be employed. In the embodiment shown in FIG. 10, the inner ends of the arms 13 carry jaw members or clamps 53 having bottom hooks 55 for fitting in slots formed in the underside of the article carrier 17'. Similar hooks 59 are provided at the tops of the clamps for fitting in slots 61 in the top panel of the article carrier. The tops of the end clamps can terminate at the hooks 59, corresponding to the C-shaped construction of the clamp shown at the right of FIG. 10, or an inward extending flange 63 can be provided to fit over a longer section of the top panel of the carrier for a more secure fit.

Figure 11:
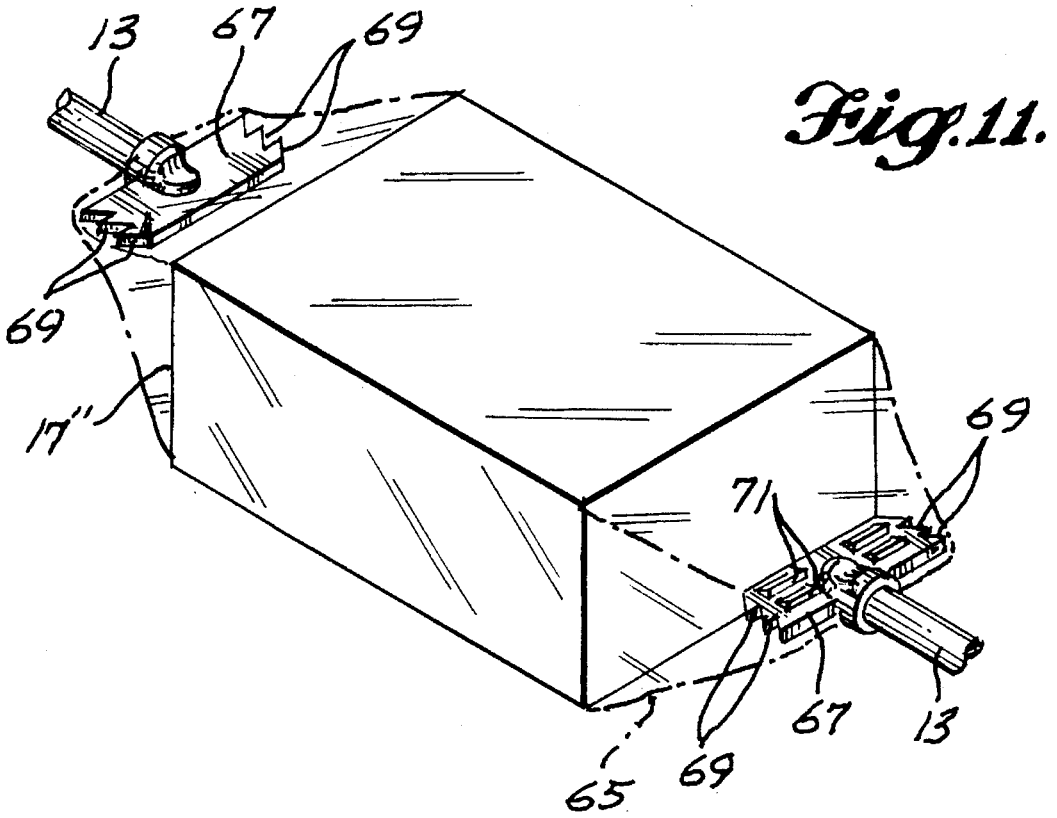
FIG. 11 is a fragmentary top perspective illustrating another modified interface between the outer support member and the inner article carrier.

In the embodiment illustrated in FIG. 11, the article carrier 17" (which could be the article itself) is first fitted in a flexible plastic sheath or tube 65. The open ends of the tube are fitted over cross plates 67 carried on the inner ends of the arms 13. Plates 67 are formed with teeth or barbs 69 at opposite sides and, optionally, teeth or barbs 71 along the top and/or top and bottom surfaces of the plates. Preferably, the plastic material of the tube or sheath is flexible, but substantially nonresilient, and of a type which will shrink when heated. After insertion of the cross plates into the ends of the tube, application of heat causes the material to shrink to such an extent that the tube ends are securely tightened on and thereby connected to the cross plates.

Figure 12:
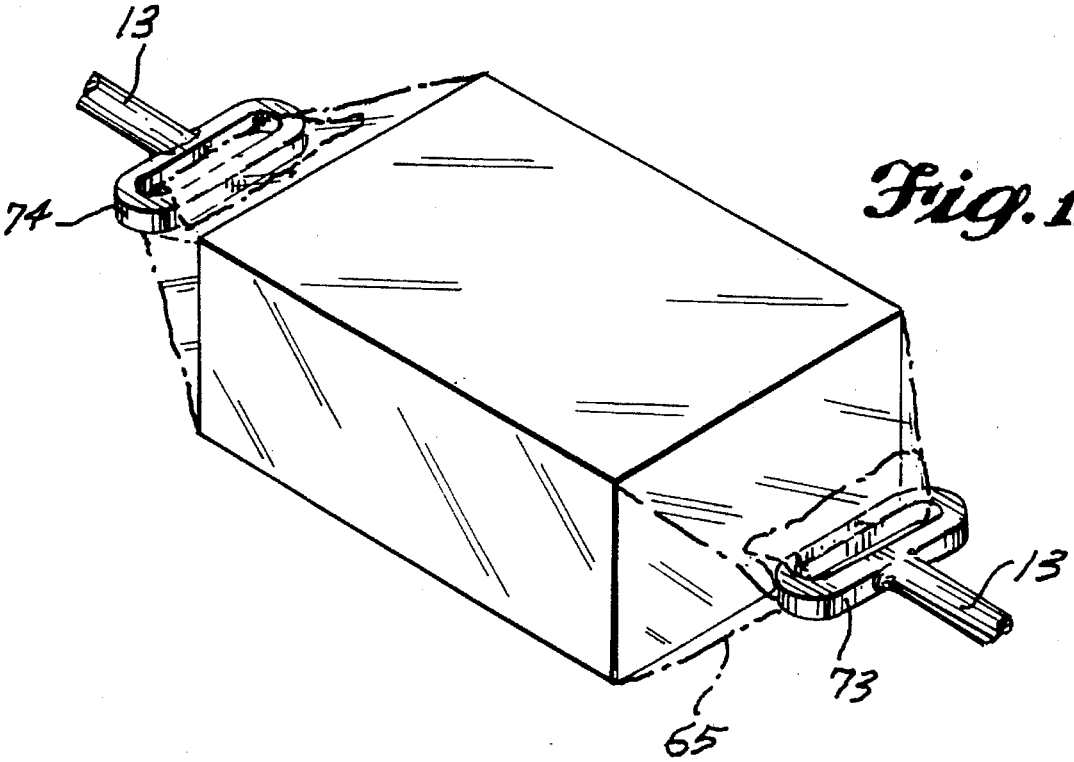
FIG. 12 is a fragmentary top perspective illustrating another modified interface between an outer support member and an inner article carrier.

The embodiment illustrated in FIG. 12 is similar to the embodiment illustrated in FIG. 11 except that the ends of the plastic sheath or tube 63 are inserted through tings 73 provided on the inner ends of the arms 13 rather than being inserted over connector members carried on the arms. The sheath or tube ends then are folded back over themselves and tensioned. The folded ends can be secured by adhesive, stapling, ultrasonic welding or heat sealing while tensioned, followed by heating of shrink type material to achieve the desired tensioning to figidify the carder tube.

Regardless of the method used to interface the article carder inside the support member, the cushioning material in the chambers of the outer support member tends to return the article carrier to a central position, but permits shock absorbing motion of the carrier from such position by reciprocal action of the embedded plates. When not in use, the carder can be removed, and the top and bottom flaps can be opened for folding the outer container in parallelogram fashion to a more compact condition. In this regard, if for a specific application the inward extending arms interfere with the extent to which the container can be folded compactly, the arms can be constructed to be retractable or hinged, but preferably are rigid when the container is reassembled ready for insertion of the article carder.

FIGS. 13 through 40 illustrate a second embodiment of the present invention utilizing an inner article carrier resiliently held inside an outer support member, but without using embedded plates and rigid support arms. In the form shown in FIGS. 13 and 14, the outer support member is a rectangular box 100 (FIG. 14) that can be formed from a one-piece blank 101 (FIG. 13) of rigid or substantially rigid material such as corrugated cardboard. Proceeding from the upper left of FIG. 13, the blank includes a left end panel 102 having an integral top flap 104 and bottom flap 106 cantilevered from its top edge (score line 108) and bottom edge (score line 110), respectively. A front panel 112 has corresponding top and bottom flaps 114 and 116, respectively, and is joined to the left end panel 102 at a score line 113. A fight end panel 118 of the box blank 101 is joined to front panel 112 along its opposite edge (score line 119) and has top and bottom flaps 120 and 122. A back panel 124 is joined to panel 118 along a score line 125 opposite the end joined to front panel 112. Top and bottom flaps 126 and 128 project from the top and bottom of the right end panel 124. Finally, a glue tab 130 projects from the end of back panel 124 opposite the right end panel 118.

Resilient cushioning material, preferably foam pads 132, are secured to the interior faces of end panels 102 and 118, such as by suitable adhesive. Thereafter, the blank is foldable to the rectangular condition shown in FIG. 14. In such folded condition, the glue tab overlaps the left end panel and is affixed thereto by gluing or mechanical fasteners. The cushioning material 132 projects inward into the otherwise open interior of the support member or box 100.

Figure 14:
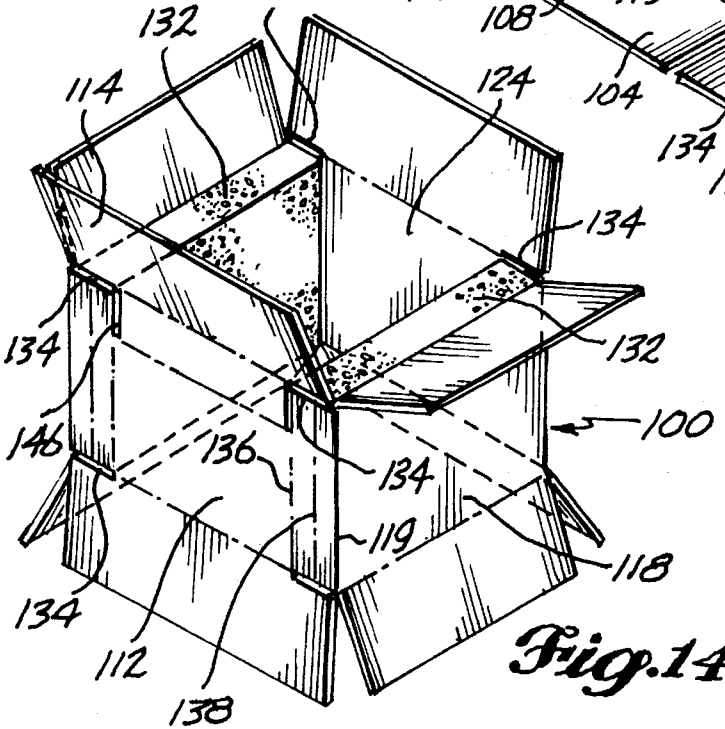
FIG. 14 is a top perspective of the box blank and cushioning members of FIG. 13 partially assembled.
Figure 15:
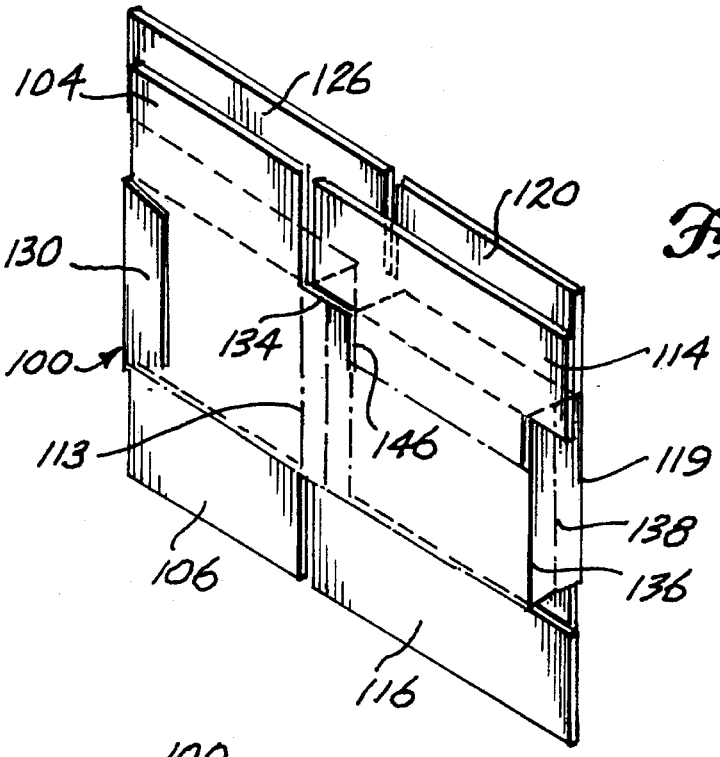
FIG. 15 is a top perspective of the outer support member of FIG. 14 with parts in different positions, namely, with such support member folded to compact condition.
Figure 16:
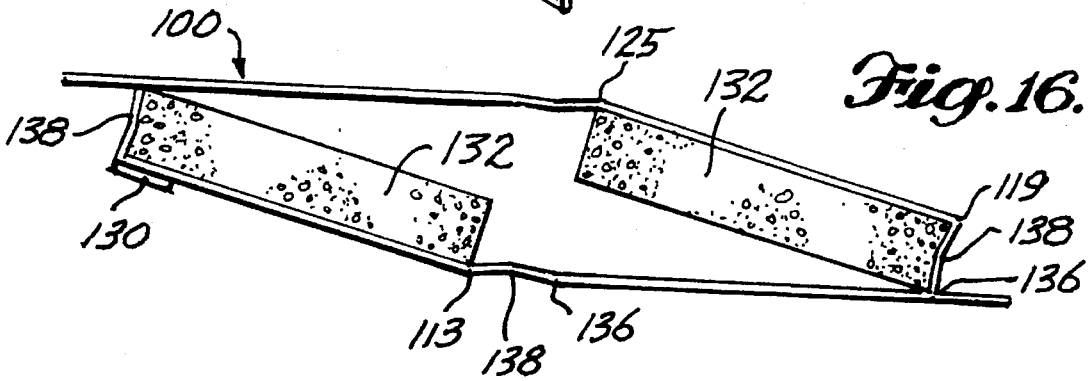
FIG. 16, FIG. 17, and FIG. 18 are corresponding top plans illustrating folding of the outer support member of FIG. 14 from its open condition shown therein to the compact condition illustrated in FIG. 15.
Figure 17:
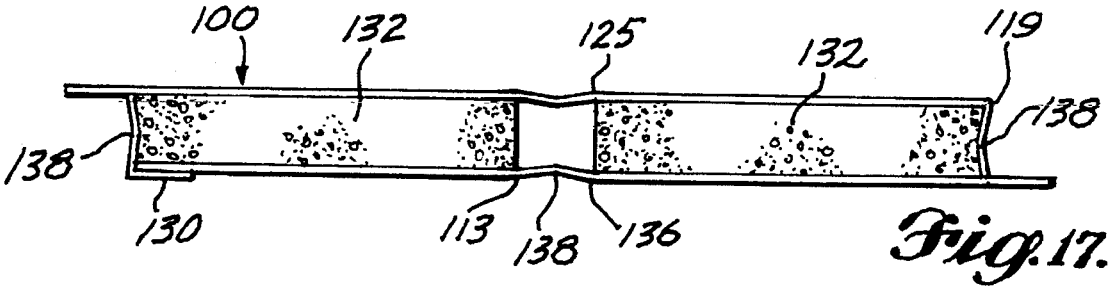
Figure 18:
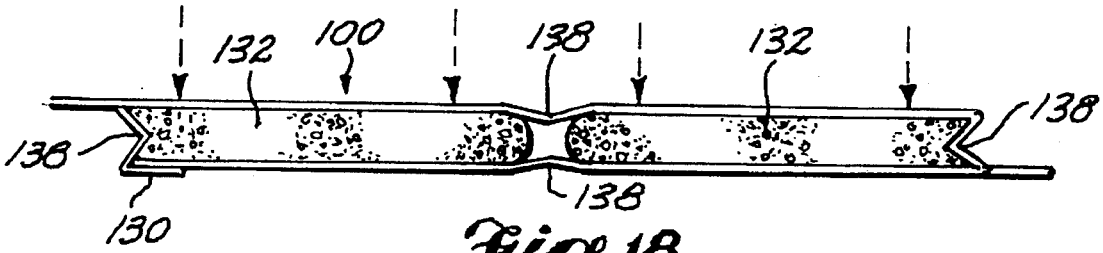

With the top and bottom flaps in their open conditions shown in FIG. 14, the support member or box 100 can be folded in parallelogram fashion to a more compact condition. More specifically, horizontal slits 134 are formed along the top and bottom edges of the front and back panels 112 and 124 in the areas where the flaps are approximately registered with the pads 132, and additional vertical score lines 136 extend along the front and back panels between the inner ends of corresponding slits 134. Thus, the box 100 can be folded to the condition shown in FIG. 15 in which each end panel is coplanar with one of the front and back panels, and directly opposite and parallel to the other of the front and back panels. For example, the left end panel 102 is coplanar with the front panel 112, and is opposite the back panel. FIGS. 16 and 17 illustrate progressive stages of folding of the open box. For an even more compact arrangement, the upright end portions of the front and back panels 112 and 124 have additional score lines 138 that permit the cushioning material 132 to be compressed by enabling an accordion-like folding or crumpling of the panels along the additional score lines as shown in FIG. 18. Thus, the partially assembled boxes can be compactly shipped to a desired destination.

With reference to FIG. 19, at the desired destination the outer support member or box 100 can be returned to its rectangular configuration. An article carrier 140, such as a conventional cardboard mailer, is sized to fit snugly between the opposing pads 132. As illustrated in FIG. 19, the article carrier 140 can have a layer of pressure-sensitive adhesive 142 applied at each end, protected by a conventional release sheet or strip 144. After the strips 144 are removed, the article carrier 140 is carefully fitted inside the box 100, with the ends of the carder approximately centered with respect to the pads 132 as best seen in FIGS. 20, 22 and 23. The top and bottom of the article carrier 140 are spaced below the top and bottom of the outer box, and the front and back of the article carrier are spaced inward from the front and back of the box. Also, upright slits 146 are formed in the upper portion of the front panel 112, leading to the top flap 114, so that the front of the box can be opened to the condition shown in FIG. 20 along horizontal score lines 145 and 147 for convenient access to the article carrier 140. Preferably the article carrier 140 opens from the top for insertion of the article to be shipped. While a standard top-opening cardboard mailer is illustrated, it should be understood that other types of interior article carriers can be used, such as thermoformed plastic clam shell constructions. Another alternative is to attach the ends of the article itself directly to the pads 132. Consequently, as used herein the term "article carrier" includes such a construction in which there is a direct connection of the article to the pads.

After insertion of the article carrier, the top and bottom flaps of the outer box can be closed to the condition shown in FIG. 21 and conventionally secured in position for shipping, such as by tape, adhesive, staples or standard lock tabs.

With reference to FIGS. 22 and 23, the inner article carrier 140 is normally held in a stable equilibrium position with its top, bottom and sides out of contact with the outer box 100. However, in the case of jarring or a jolt severe enough that the shipped article may be damaged, the inner carrier will move relative to the outer box. In the case of endwise movement, the cushioning material or pad 132 at one end will be compressed, whereas the pad at the other end will be tensioned. The reciprocal action (compression at one end and tension at the other, both resiliently resisting movement of the inner carrier) provides an extremely efficient shock absorbing protection for the article. The reciprocal action of the opposing cushioning members applies also with respect to up and down movement or transverse movement, in which case one section of each cushion is compressed while another section of each cushion is tensioned.

Preferably the composite shipping package in accordance with the present invention is reusable. For example, at the desired destination the article is unloaded by opening the top flaps of the outer box 100 and the top flap of the article carrier 140. Thereafter, the bottom flaps of both the outer support member and article carrier can be opened, such that the package can be folded to a more compact condition for storage or shipment to another location. With all flaps open the composite package can be folded in parallelogram fashion from the bulky rectangular condition through the positions shown in FIGS. 24 and 25 to the more compact condition illustrated in FIG. 26.

FIGS. 13 through 26 illustrate the preferred cushioning material, namely, pads 132 of resilient foam having outer end faces secured to the box end panels and inner faces secured to the opposite ends of the article carrier. Such pads can be rectangular blocks of approximately the same profile size and shape as the end panels of the outer box or, as illustrated in FIG. 27 (on the drawing sheet with FIGS. 13 and 14) can have beveled sides and ends 148 tapering to the inner face 150 where the article carrier is secured. In either event, different foams can be used for different flex characteristics, or the flex or stiffness can be selected by using foams of different densities and indentation load deflection (ILD) ratings to customize the package for an article of a particular weight and degree of fragility.

FIGS. 28 and 29 illustrate an alternative form of cushioning member or "material" secured to the opposite ends of the outer support member 100. A single C-shaped piece 152 of resilient plastic has its coplanar opposite ends 154 secured to an end panel, such as the left panel 102, with a planer central portion or web 156 for attachment to the corresponding end of the article carrier 140. The curved top and bottom portions 158 of the C-shaped member provide the desired resilient cushioning action for movement up and down or endwise. An identical member would be provided at the opposite end of the outer box 100.

In the form shown in FIGS. 30 and 31, a substantially rigid C-shaped flange 160 has its central web 162 secured to an end panel of the outer box 100, to support an upright sheet of resilient film 164 spaced inward from the adjacent box end. An identical flange supporting a sheet of resilient film is provided at the opposite end panel of the box. The opposite ends of the article carrier 140 are secured directly to the central portions of the sheet, for the desired reciprocal shock-absorbing motion by resilient deformation of the sheets.

In the modification illustrated in FIG. 32, a pneumatic airbag 166 is secured at each end of the outer box 100, and the opposite ends of the article carrier 140 are secured to the inner faces 168 of the bags. Each bag has an internal strap 170 having its opposite ends joined, respectively to the opposite upright walls of the bag. Movement of the article carrier 140 from the equilibrium central position shown in FIG. 33 is resisted by the pneumatic characteristics of the bags, and also by resistance of the internal straps to deformation.

Similarly, in the embodiment illustrated in FIGS. 34 and 35, an airbag 172 is secured at each end of the outer box 100, but in this case with two internal straps 174 having horizontal portions secured side-by-side, and coplanar end portions 176 and 178. The end portions 176 remote from the article carrier 140 overlie the major portion of the area of the adjacent box end panel, and inner end portions 178 of the straps overlie substantially the full area of the adjacent end portion of the article carrier 140. As for the previously described constructions, the opposite ends of the article carrier 140 are secured directly to the interior face 180 of the cushioning member or "material" in the form of the airbags for shock-absorbing support of the carrier.

FIGS. 36–38 illustrate a modification in which an inner article container 140' is mechanically connected to the inner face of cushioning material at the ends of the outer box 100, in this case, resilient foam pads 132. A foldable connection bracket or strip 182 has a central portion or panel 185 of approximately the same size as the adjacent end panel 186 of the carrier member. The carder member 140' has a top flap 187 and a bottom flap 188 that can be opened to the condition shown in FIG. 36 to expose the upright rectangular periphery of the carrier. With the carrier placed with end panel 186 abutting the central portion 185 of the connection bracket 182, top and bottom flaps 190 and 192 of the connection member are folded inward, over the top and bottom edges of the adjacent end of the carrier, to the condition illustrated in FIG. 37 in which the flaps are disposed within the inner carrier member and extend close alongside the inner face 193 of the carrier member end panel. One or both of the flaps can have projecting tabs 194 for fitting in slots 195 of the carrier member to retain the flaps 190 and 192 in the folded condition. While only the left end portion of the outer box 100 is illustrated in FIGS. 36, 37 and 38, it should be understood that the right end of the box would be identical, for firmly connecting the inner carrier member 140' to both ends of the outer box 100. The top and bottom flaps 187 and 188 of the carder are slightly narrower than the front and back panels to which they are connected so that they can be tucked inward alongside the folded flaps 190 and 192 to assist in retaining the connector flaps in the folded positions. A surprisingly strong interconnection of the inner carrier member 140' with the pads 132 at the opposite ends is obtained, so that the reciprocal shock-absorbing action of the embodiment illustrated in FIGS. 36, 37 and 38 is identical to the action of the embodiment shown in FIGS. 13–26, for example. An advantage of the form shown in FIGS. 36, 37, and 38 is that no adhesive is required to connect the opposite ends of the carrier to the resilient pads at the shipping location, making this modified form of the invention easier to use. In addition, the component parts can be knocked down after use for more compact storage.

As discussed above, when resilient foam pads are used, they can have their outside faces adhered to the inner face of the outer box. FIGS. 39 and 40 illustrate modifications for pads 132' that are foamed in place. The inner sheet 196 of a corrugated cardboard box end 197 has small holes 198 scattered throughout, so that when the pad 132' is foamed in place in contact with the box end, the foam will penetrate the inner sheet 196 of the corrugated cardboard and thereby affix the pad to the end of the box.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A shock absorbing package for an article comprising an outer support member having a hollow interior and opposite ends spaced apart, a cushion secured to each of said opposite ends and projecting into said interior, said cushion at each end having an inner face opposing and spaced apart from the inner face of the cushion at the other end, and an article carrier having opposite ends joined to said inner faces of said cushions for resilient support of said article carrier on said cushions, whereby shock absorbing motion of said inner carrier is accomplished by resilient deformation of said cushions, said outer support member being a rectangular box, each cushion being a pad of resilient foam having an outer face secured to an end of said box and an inner face connected to an end of said article carrier, said article carrier being a rectangular box having a top opening flap, and including a connection bracket having a portion secured to the inner face of each cushion and foldable flap members insertable into said article carrier for mechanically connecting said article carrier to said resilient pads.

2. The package defined in claim 1, in which the outer support member is a rectangular box, the article carrier being a box member of a size smaller than the outer box, the outer box and article carrier having corresponding top, bottom and side portions spaced relatively apart with no intervening interconnecting structure for enabling free movement of the article carrier relative to the outer box by deformation of the cushions secured to the opposite ends of the article carrier.

3. The package defined in claim 1, in which each cushion is secured between one of the ends of the outer support member and one of the opposite ends of the article carrier such that the article carrier is movable relative to the outer support member by reciprocal resilient deformation of the cushions.

4. The package defined in claim 1, in which the support member has a first end panel, a second end panel disposed opposite said first end panel, and first and second side panels extending between said end panels and disposed opposite from each other, said panels encircling the hollow interior and defining a top opening and a bottom opening, the support member further including parallel score lines aligned with the inner faces of the cushions for enabling the support member with the cushions secured therein to be folded in parallelogram fashion into a substantially flat condition.

5. The package defined in claim 4, in which one of the side panels has a top edge adjacent to the top opening, the box including a top flap extending from said side panel top edge and swingable relative thereto into the top opening, the box further including a slit between said top flap and the side panel from which said top flap extends adjacent to one of the end panels.

6. A shock absorbing package for an article comprising an outer rectangular box having an open interior including opposing interior end faces, two end cushions secured, respectively, to the interior end faces of said outer box, said cushions having respective outer faces joined to said end faces of said box and interior faces opposite said outer faces which interior faces are spaced apart lengthwise of said box, and an inner article carrier having planar end faces secured, respectively, to said interior faces of said cushions, said outer box and inner carrier having corresponding tops, bottoms and sides spaced apart, said carrier being connected to said outer box solely through said end cushions for enabling shock absorbing movement of said inner carrier member relative to said outer box by reciprocal action of said cushions at the opposite ends of said box, said box having four corners each approximately aligned with one of said outer faces of said cushions and parallel first score lines approximately aligned with said interior faces of said cushions for enabling said box with said cushions secured therein to be folded in parallelogram fashion into substantially flat condition.

7. The package defined in claim 6, including additional score lines disposed between the box corners and the first score lines for enabling compression of the parallelogram folded box with the cushions secured therein by accordion-like folding of the box between the box corners and the first score lines.

8. The package defined in claim 6, in which the outer support member box has opposite side panels and opposite end panels defining a top opening, one of the side panels having a top edge adjacent to the top opening, the box including a top flap extending from said side panel top edge and swingable relative thereto into the top opening, the box further including a slit between said top flap and the side panel from which said top flap extends adjacent to one of the end panels.

9. The package defined in claim 6, in which the end cushions include airbags.

10. The package defined in claim 6, in which the end cushions include resilient pads.

11. The package defined in claim 6, in which the end cushions include resilient foam.

12. The package defined in claim 11, in which the resilient foam is secured to the interior end faces of the outer box by being foamed in place in contact with the interior end faces of the outer box.

13. The package defined in claim 6, in which the cushions include C-shaped bracket members.

14. The package defined in claim 13, in which the C-shaped bracket members are resilient.

15. The package defined in claim 13, in which each C-shaped bracket member includes a central web portion, opposite leg portions spaced from the central web portion and a section of sheet material extending between the opposite leg portions.

16. A shock absorbing package for an article comprising an outer support member having a hollow interior and opposite ends spaced apart, a cushion secured to each of said opposite ends and projecting into said interior, said cushion at each end having an inner face opposing and spaced apart from the inner face of the cushion at the other end, and an article carrier having opposite ends joined to said inner faces of said cushions for resilient support of said article carrier on said cushions, whereby shock absorbing motion of said article carrier is accomplished by resilient deformation of said cushions, and including a connection bracket having a portion secured to the inner face of each cushion and at least one foldable flap member connectable to said article carrier for securing said article carrier to said cushions.

17. The package defined in claim 16, in which the at least one foldable flap member of each connection bracket is insertable into the article carrier for securing the article carrier to the cushions.

18. The package defined in claim 17, in which each connection bracket includes at least two oppositely disposed foldable flap members insertable into the article carrier for securing the article carrier to the cushions.

19. The package defined in claim 16, in which the article carrier is a rectangular box, the at least one foldable flap member of each connection bracket being insertable into said article carrier box for securing said article carrier box to the cushions.

20. The package defined in claim 16, in which the cushions include resilient foam.

21. The package defined in claim 20, in which the resilient foam cushions are secured at the opposite ends of the support member by being foamed in place in contact with the ends of the support member.

22. The package defined in claim 16, in which the outer support member is a rectangular box having four corners each approximately aligned with an outer face of one of the cushions, said box having parallel first score lines spaced from said corners and approximately aligned with inner faces of the cushions for enabling the box with the cushions secured therein to be folded in parallelogram fashion into substantially flat condition.

23. The package defined in claim 22, including additional score lines disposed between the box corners and the first score lines for enabling compression of the parallelogram folded box with the cushions secured therein by accordion-like folding of the box between the box corners and the first score lines.

24. The package defined in claim 22, in which the outer support member box has opposite side panels and opposite end panels aligning a top opening, one of the side panels having a top edge adjacent to the top opening, the box including a top flap extending from said side panel top edge and swingable relative thereto into the top opening, the box further including a slit between said top flap and the side panel from which said top flap extends adjacent to one of the end panels.

25. A shock absorbing package for an article comprising an outer rectangular box having an open interior including opposing interior end faces, two end cushions for supporting the article and secured, respectively, to the interior end faces of said outer box, said cushions having respective outer faces joined to said end faces of said box and interior faces opposite said outer faces which interior faces are spaced apart lengthwise of said box, said box having four comers each approximately aligned with one of said outer faces of said cushions and parallel first score lines approximately aligned with said interior faces of said cushions for enabling said box with said cushions secured therein to be folded in parallelogram fashion into substantially flat condition.

26. The package defined in claim 25, including additional score lines disposed between the box corners and the first score lines for enabling compression of the parallelogram folded box with the cushions secured therein by accordion-like folding of the box between the box corners and the first score lines.

27. The package defined in claim 25, in which the box has opposite side panels and opposite end panels defining a top opening, one of the side panels having a top edge adjacent to the top opening, the box including a top flap extending from said side panel top edge and swingable relative thereto into the top opening, the box further including a slit between said top flap and the side panel from which said top flap extends adjacent to one of the end panels.

* * * * *